US006148598A

United States Patent [19]

Gabalda et al.

[11] Patent Number: 6,148,598

[45] Date of Patent: Nov. 21, 2000

[54] THREAD DELIVERY DEVICE FOR A TEXTILE SPINNING, THROWING, TEXTURING OR SUCHLIKE MACHINE

[75] Inventors: Carlos Matas Gabalda, Granges les Valence; Jean-Claude Dupeuple, Saint Genis Laval, both of France

[73] Assignee: ICBT Yarn, Roanne, France

[21] Appl. No.: 09/248,412

[22] Filed: Feb. 11, 1999

[30] Foreign Application Priority Data

Mar. 4, 1998 [FR] France ..... 98 02858

[51] Int. Cl.[7] ..... B65H 57/00

[52] U.S. Cl. ..... 57/352; 57/90; 57/92; 57/103; 28/240; 28/244; 28/245; 425/29; 425/66; 425/492

[58] Field of Search ..... 57/90, 92, 103, 57/352; 28/240, 244, 245; 425/66, 29, 492

[56] References Cited

U.S. PATENT DOCUMENTS

| | | | |
|---|---|---|---|
| 2,853,738 | 9/1958 | Pfenningsberg | 18/8 |
| 3,137,033 | 6/1964 | Maaskant . | |
| 3,747,863 | 7/1973 | Klementz et al. | 242/47.08 |
| 3,868,815 | 3/1975 | Stahlecker | 57/88 |
| 5,665,043 | 9/1997 | Hasselberg et al. | 492/10 |

FOREIGN PATENT DOCUMENTS

| | | |
|---|---|---|
| 1535468 | 3/1967 | France . |
| 2206753 | 5/1974 | France . |

*Primary Examiner*—John J. Calvert
*Assistant Examiner*—Mary Kay Fiore
*Attorney, Agent, or Firm*—Wall Marjama & Bilinski

[57] ABSTRACT

It comprises a bowl (2) driven positively in rotation and a guide finger (3) which is spaced from the bowl (2) and is mounted on an arm (6) articulated relative to a support (7) mounted on the frame of the machine.

The shaft (8) supporting the bowl (2) is equipped with a drive roller (12) which, in the working position, bears against a drive shaft extending over the entire length of the machine and common to all the workstations which the latter comprises.

The articulated arm (6) is associated with means which, on the one hand, hold the drive roller (12) in bearing contact, with adjustable pressure, against the drive shaft during normal operation and, on the other hand, are neutralized when the articulated arm is moved away from said drive shaft.

3 Claims, 2 Drawing Sheets

THREAD DELIVERY DEVICE FOR A TEXTILE SPINNING, THROWING, TEXTURING OR SUCHLIKE MACHINE

TECHNICAL FIELD

The present invention relates to the technical sector of the manufacture of threads, especially chemical threads, and is concerned, more particularly, with an improvement made to the so-called "delivery" assemblies which make it possible to deliver or take up the thread at a predetermined speed, in order to carry out the various treatment phases involved in the manufacture of chemical threads, such as, for example, the drawing phase.

PRIOR ART

Various types of proposals have been made hitherto for delivering threads during their manufacture.

On machines intended for carrying out treatments subsequent to the actual spinning phase, such as texturing machines, stranders, twisters and throwers, use is made, more particularly, of deliveries of the so-called apron, press-cylinder or capstan type, in which the thread to be taken up or to be delivered is held laid against the surface of a cylinder or drive shaft by means of a pressing element (roller, roll, belt).

In addition to these devices, in which the thread to be taken up or to be delivered is therefore held nipped between two surfaces, it has been proposed, especially in order to carry out the phase of drawing the chemical threads produced, after their actual spinning, to employ, as may be gathered especially from FR-A-1,535,468 or from U.S. Pat. No. 3,137,033, deliveries which consist of a cylinder or drum, also called a "bowl", this element being designated by (55,57) in the abovementioned French Patent and by (8) in the US patent, said element being capable, if appropriate, of being heated, especially by induction, and being driven in rotation, associated with a roller or finger of smaller diameter which, itself, is mounted freely in terms of rotation and is spaced from the abovementioned drum, these elements being designated respectively by (56,58) in the French Patent and by (9) in the US patent.

In these devices, the rotationally free guide finger or roller has an axis inclined relative to the plane containing the axis of the cylinder or drum, forming a plurality of turns around these elements.

Such assemblies are particularly suitable when it is desired to operate at high production speeds, and, above all, make it possible to avoid any pressure on the surface of the threads, thus avoiding damaging them.

One of the problems of such delivery assemblies is that of driving in rotation the drum or bowl which, if appropriate, may be of the heating type.

The conventional solution for carrying out such a drive involves, as may be gathered from FR-A-1,535,468, having a main motor which imparts the desired speed to the rotary drum by means of a conventional mechanical transmission.

However, such a mechanically reliable solution has the disadvantage that, especially when action is to be taken on a workstation as a result of a break, the machine as a whole has to be stopped.

In order to overcome this disadvantage, it has been proposed, as emerges especially from FR-A-2,206,753, to control each delivery by means of an individual electric motor, the drum or bowl and the rotor of the motor being mounted on a common shaft.

Such a procedure makes it possible to act on a station of the machine, thus avoiding production losses and faults. It has the disadvantage, however, of resulting in complex solutions, especially as regards regulating the speed of the motors of each station. Moreover, since each delivery is equipped with a motor, this gives rise to an appreciable increase in the cost price of the machines.

PRESENTATION OF THE INVENTION

An improvement has been found, then, this being the subject of the present invention, which is made to such types of delivery having a bowl and a guide finger and which, on the one hand, preserves the advantages of driving all the deliveries, which are to rotate at the same speed, by means of a single motor, whilst at the same time making this driving much simpler than the mechanical transmissions used previously, and, on the other hand, above all, makes it possible to act on a workstation, without stopping the operation of the corresponding deliveries of the other stations.

In general terms, the invention therefore relates to a thread delivery of the type consisting of a bowl or drum driven positively in rotation and of a guide finger which is spaced from the periphery of the abovementioned bowl and is mounted freely in terms of rotation on a support and the axis of which is inclined relative to the plane containing the axis of the bowl, the thread to be taken up or to be delivered executing a number of predetermined revolutions around the abovementioned elements and therefore having a spiral run.

The delivery according to the invention is defined in that:

- the bowl and the guide finger are mounted on an arm articulated relative to a support mounted fixedly on the frame of the machine;
- the shaft supporting the bowl is mounted on the arm by means of bearings and projects laterally relative to said arm and, at its free end, is equipped with a drive roller which, in the working position, bears against a drive shaft extending over the entire length of the machine and common to all the workstations which the latter comprises;
- the articulated arm is associated with means which, on t he o ne hand, hold the drive roller in bearing contact, with adjustable pressure, against the drive shaft during normal operation and, on the other hand, are neutralized when the articulated arm is moved away from said drive shaft.

According to a simple embodiment, the means ensuring pressure against the drive shaft consist of a spring, one end of which is integral with the bearing supporting the bowl and the other end of which is connected to the fixed support mounted on the frame of the machine, the pivot axis of the supporting arm being positioned in such a way that, in the working position, the spring tends to lay the drive roller of the bowl against the drive shaft and, in the raised position, said spring holds the supporting arm in the position moved away from said drive shaft.

According to a preferred embodiment, the bowl is associated with conventional heating means, such as electric heating, induction heating.

However, the invention and the advantages which it affords will be understood better from the following exemplary embodiment which i s given below as a non-limiting indication and which is illustrated in the accompanying diagrams.

BRIEF DESCRIPTION OF THE DRAWINGS

The accompanying Figures illustrate in detail the structure and operation of a delivery produced according to the invention.

EMBODIMENT OF THE INVENTION

Figure 2:
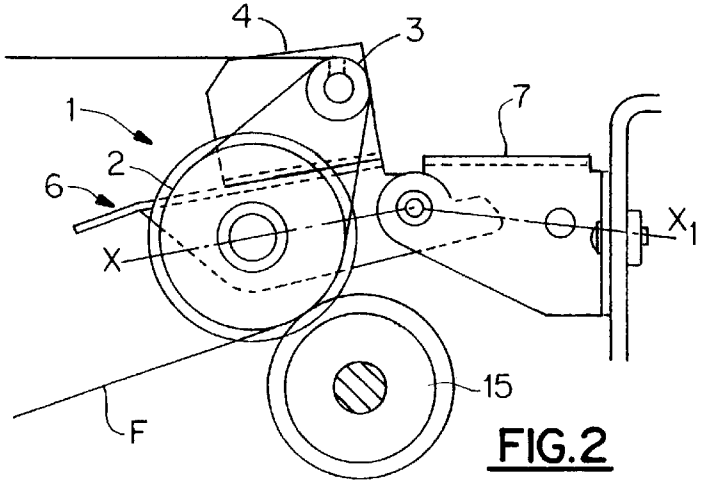
FIG. 2 is a side view of FIG. 1, showing in more detail the positioning of the various elements forming the delivery according to the invention, in the position slipped onto a drive shaft common to a line of deliveries.

Referring to the accompanying diagrams, the delivery according to the invention, designated by the general reference (1), is of the type consisting of a bowl or drum (2) which is driven positively in rotation and with which a guide finger (3) is associated. This guide finger (3) is spaced from the periphery of the bowl (2) and is mounted freely in terms of rotation on a support (4). The finger (3) is mounted on the support (4) by means of a bearing (5), in such a way that its axis is inclined relative to the plane containing the axis of the bowl (2), so that the thread (F) to be taken up or to be delivered executes a number of predetermined revolutions around a bowl (2)/finger (3) assembly, in a spiral run.

In accordance with the invention, the bowl (2) and the finger (3) are mounted at the end of an arm, designated by the general reference (6), which is articulated relative to a support (7), itself mounted on the frame of the machine. The articulated arm (6) consists, in a simple way, of a U-shaped profile (see FIG. 1), the side walls **(6*a*, 6*b*) of which serve as a support for a bearing housing (20), within which is mounted a shaft (8) which is free in terms of rotation relative to said arm (6) by means of rolling bearings (9*a*, 9*b*)**.

The support (4) of the guide finger (3) is, itself, mounted directly on the upper face of the arm (6).

The articulation of the arm (6) on the frame of the machine is obtained by two bearings **(10*a*, 10*b*), provided laterally on the support (7), by means of two shafts (11*a*, 11*b*)**.

The shaft (8) projects laterally on either side of the arm (6) and supports the bowl (2) at one end of said shaft and, and at its other end, a drive roller (12) preferably comprising a peripheral covering (13) made, for example, of rubber.

Figure 3:
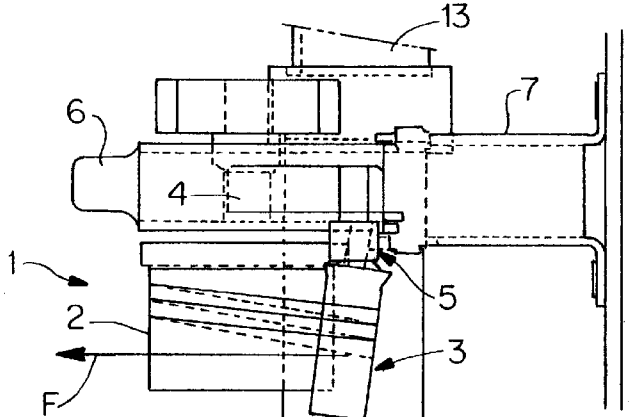
FIG. 3 is a top view of FIG. 2.
Figure 1:
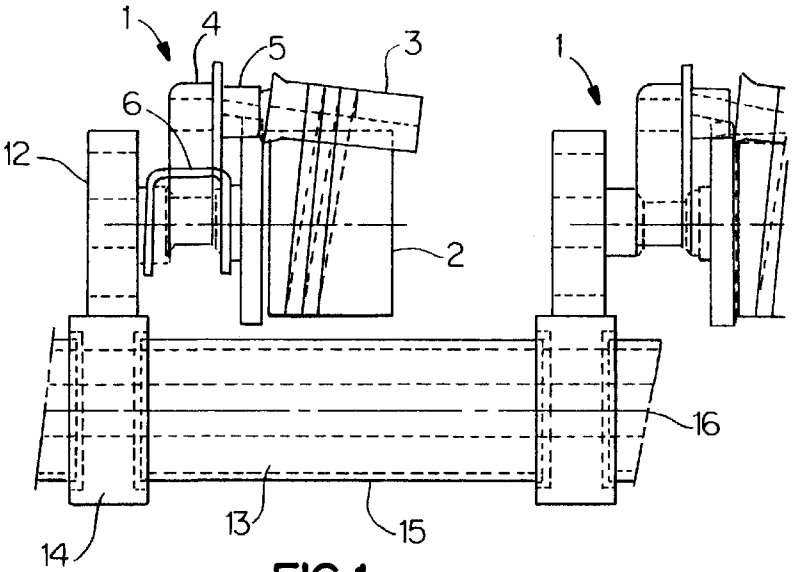
FIG. 1 is a front elevation view showing the structure of a line of deliveries which is produced according to the invention and is mounted on a machine comprising a plurality of identical work stations arranged side by side, one delivery being shown in full and a second being shown partially, and the line of the machine being capable of comprising a large number of such deliveries.

In the working position, illustrated in FIGS. 1, 2 and 3, this roller (12) bears on a drive shaft which extends over the entire length of the machine and which is common to all the workstations which the latter comprises.

If the machine requires a plurality of consecutive deliveries for each workstation, there will therefore be as many drive shafts as there are series of deliveries.

The drive shaft (13) is such that is has zones of large diameter (14), against which the drive rollers (12) bear, said zones being separated by a set-back zone (15), thus making it possible for the bowl (12) to have a clearance relative to the surface of said drive shaft.

Moreover, as may be gathered more particularly from FIGS. 1 and 2, this shaft (13) may consist of a continuous shaft (15), on which are mounted a succession of cylindrical elements intended for forming the parts (13) and the bearing surfaces (14).

Finally, the articulated arm (6) is associated with means which, on the one hand, make it possible to hold the drive roller (12) in bearing contact, with adjustable pressure, against the drive shaft during normal operation and, on the other hand, also ensure that the articulated arms are held in the position moved away from said drive shaft when action is to be taken on a station.

Figure 4:
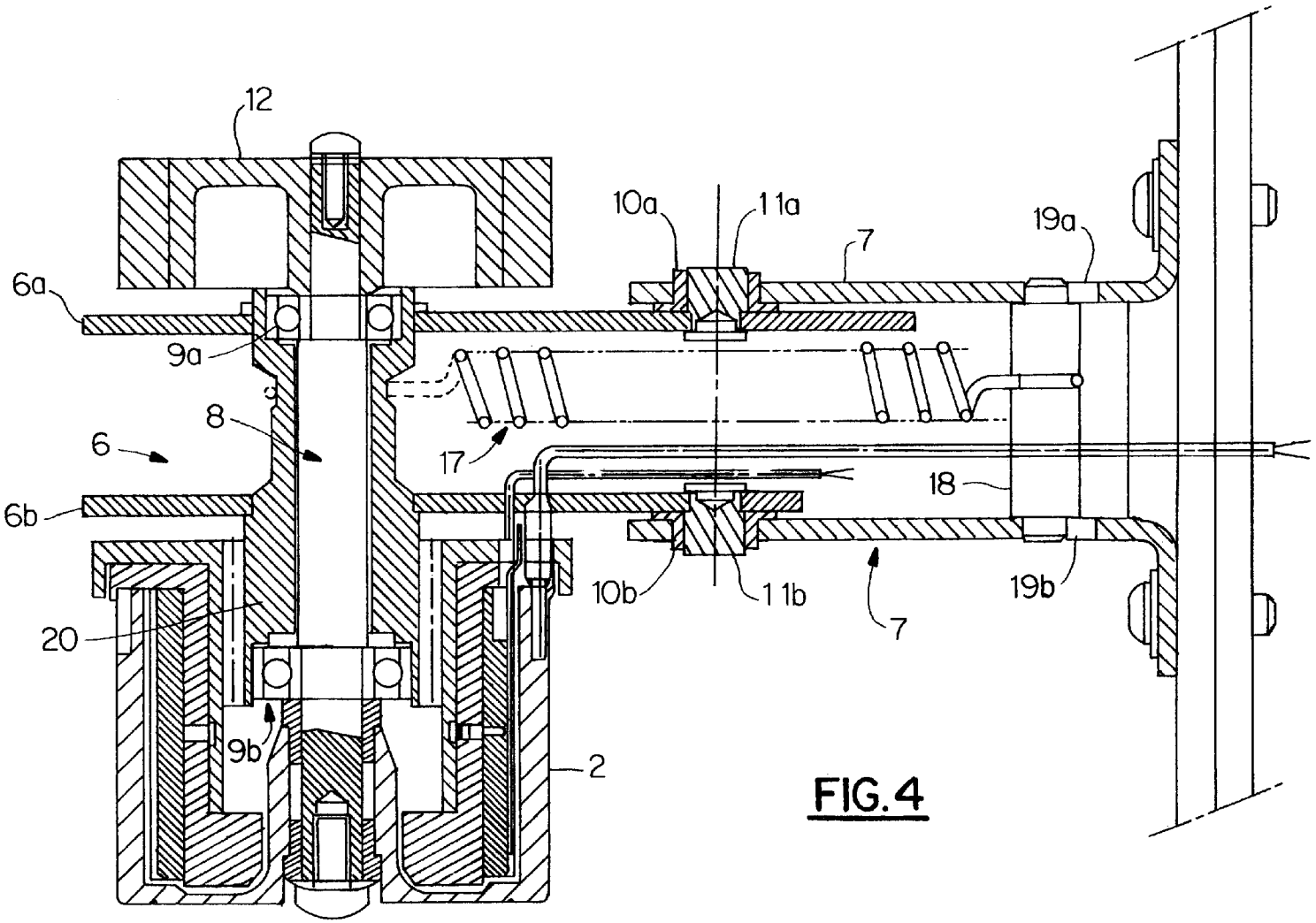
FIG. 4 is a cross section taken in the plane XX and X1 of FIG. 2, showing in detail how the heating of the bowl can be carried out and, above all, the structure of the articulated supporting arm and the return means making it possible to ensure that the drive roller bears against the drive shaft.

According to a simple embodiment, illustrated in FIG. 4, means ensuring pressure against the drive shaft consist essentially of a spring (17) which is arranged within the arm between the walls **(6*a*, 6*b*) and one end of which is integral with the bearing supporting the bowl (2) and the drive roller (12), and the other end of which is, itself, connected to the fixed support (7) integral with the frame and, in the present case, by means of a shaft (18) which can slide in lateral slots (19*a*, 19*b*) provided on the lateral faces (7)** of the support.

By virtue of such a structure and positioning of the pivot shaft **(11*a*, 11*b*) of the supporting arm, the spring tends to lay the drive roller (12) of the bowl (2) against the drive shaft in the working position and, in the raised position, the supporting arm is likewise held as a result of the action of the spring (17)**.

Finally, as illustrated in FIG. 4, the bowl is preferably associated with means of induction heating or of conventional electric resistance heating, the connections of which extend within the arm (6).

Such a design of deliveries has a great number of advantages, as compared with the prior solutions, by virtue of the fact that perfect synchronization of the speeds of the deliveries which the machine comprises is obtained, and the fact that it is possible to act on a workstation simply by disengagement by raising the supporting arm (6).

What is claimed is:

1. Thread delivery apparatus for a textile machine that contains a series of work stations, each work station including a bowl mounted for rotation upon a bowl shaft so that said bowl rotates about a first axis of rotation, a guide finger that is mounted for free rotation about a second axis of rotation, said second axis of rotation being offset from said first axis of rotation whereby thread in process can be spirally wrapped about said bowl and said guide finger, an arm upon which said bowl and said guide finger are mounted, a support member mounted in a frame that is part of said machine, said support member containing bearing means for supporting said arm for articulation within said support member so that said arm can be moved between a first working position and a second non-working position;

a drive shaft that extends a cross the machine and is common to a series of work stations, a drive roller affixed to one end of said bowl shaft, and means for holding the arm in the first working position wherein said bowl shaft is parallely aligned with the drive shaft and the drive roller is in bearing contact with said drive shaft and said means further ensures that the articulated arm is held in said second non-working position when said arms a removed from said first position to said second position.

2. The apparatus of claim 1 wherein said means holding said arm in said first and second positions is a spring that acts between a bearing housing in which said bowl shaft is contained and the support member in which the arm is articulately mounted, the pivot axis of the arm about which the arm articulates being positioned so that the spring biases the drive roller into pressure contact with the drive shaft when the arm is in the first working position and holds the drive roll away from the drive shaft when the arm is moved to the non-working position.

3. The apparatus of claim 1 that further includes heating means for heating said bowl.

* * * * *